US008480207B2

(12) United States Patent
Shepherd et al.

(10) Patent No.: US 8,480,207 B2
(45) Date of Patent: Jul. 9, 2013

(54) OVERLAP PRINTING

(75) Inventors: Matthew A. Shepherd, Vancouver, WA (US); Erick B. Kinas, Camas, WA (US); Mark H. MacKenzie, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 179 days.

(21) Appl. No.: 13/130,281

(22) PCT Filed: Jan. 28, 2009

(86) PCT No.: PCT/US2009/032227

§ 371 (c)(1), (2), (4) Date: May 19, 2011

(87) PCT Pub. No.: WO2010/087819

PCT Pub. Date: Aug. 5, 2010

(65) Prior Publication Data

US 2011/0228002 A1 Sep. 22, 2011

(51) Int. Cl.
*B41J 2/21* (2006.01)

(52) U.S. Cl.
USPC ..... 347/43; 347/15; 347/41

(58) Field of Classification Search
USPC ..... 347/9–12, 14, 15–16, 37, 40, 41, 347/43, 57
See application file for complete search history.

(56) References Cited

U.S. PATENT DOCUMENTS

| | | | | |
|---|---|---|---|---|
| 6,578,950 | B2 | 6/2003 | Matsumoto et al. | |
| 7,311,383 | B2 * | 12/2007 | Akahira et al. | 347/40 |
| 7,517,052 | B2 * | 4/2009 | Wada et al. | 347/49 |

FOREIGN PATENT DOCUMENTS

| | | |
|---|---|---|
| JP | 2005199692 | 7/2005 |
| JP | 2008049502 | 3/2008 |
| JP | 2008143065 | 6/2008 |

* cited by examiner

*Primary Examiner* — Thinh Nguyen

(57) ABSTRACT

Methods and means for imaging are provided. A sequential application hierarchy of two or more colors is defined. A page-wide print array forms images on a moving media using colored inks. Shingling is performed in accordance with the sequential application hierarchy within the overlap print zones of the page-wide print array. Images formed on the media are visually seamless and of proper hue and color saturation throughout as a result of the present teachings.

15 Claims, 4 Drawing Sheets

OVERLAP PRINTING

BACKGROUND

Page-wide array printing uses a plurality of fixed (i.e., stationary), ink jetting dies to simultaneously form images across a width-wise aspect of a moving sheet media such as paper, etc. Typically, each of the dies includes numerous rows of nozzles configured to controllably discharge ink, wherein each row of nozzles is used to apply a particular color.

In page-wide array printing, each die typically prints over a fraction of the overall width of the receiving media. A transition or "overlap print zone" exists where the respective printing ranges of adjacent dies coincide. Under typical operation, one or more colored inks are applied to media at respective partial intensities by a first die, and then additional inks of the same color or colors are applied by a second die in order to complete the desired imaging within any particular overlap print zone. This partial-on-partial ink application technique is referred to as "shingling". Shingling is performed in the interest of color consistency within the overall image, and to avoid streaks, bars, lines, step changes or other undesirable artifacts that can occur within the overlap print zone.

However, a problem arises because colored inks must be applied in a specific order for the resulting hues to be formed as desired on the media (e.g., paper, etc.). This problem is exacerbated within overlap print zones where some kind of shingling scheme is used in order to visually join or "stitch together" those respective areas that are imaged by individual dies within a page-wide array.

Accordingly, the embodiments described hereinafter were developed in light of the foregoing and other drawbacks associated with the page wide array printing.

BRIEF DESCRIPTION OF THE DRAWINGS

The present embodiments will now be described, by way of example, with reference to the accompanying drawings, in which.

DETAILED DESCRIPTION

Introduction

Methods and means for imaging on paper media using a page-wide print array in accordance with a sequential application hierarchy of colors are provided.

In one embodiment, a method is performed using a device having a first die and a second die. The first and second dies define an overlap print zone. The method includes applying an ink of a first color over a media within the overlap print zone. The method also includes applying an ink of a second color over the media within the overlap print zone. The ink of the first color and the ink of the second color are applied such that at least two distinct, adjacent shingles are formed within the overlap print zone.

In another embodiment, one or more computer-readable storage media are provided. The one or more computer-readable storage media include a program code. The program code is configured to cause one or more processors to control application of an ink of a first color over a media within an overlap print zone. The program code is further configured to cause the one or more processors to control application of an ink of a second color over the media within the overlap print zone. Control is performed such that at least most of the ink of the first color is not applied over the ink of the second color within the overlap print zone. The ink of the first color and the ink of the second color are applied so as to form at least a portion of an image within the overlap print zone.

In yet another embodiment, a device includes a first die and a second die, the first and second dies configured to discharge ink. The first die and the second die define an overlap print zone. The device also includes a controller that includes electronic circuitry. The controller is configured to control application of a first color of ink over a media within the overlap print zone. The controller is further configured to control application of a second color of ink over the media within the overlap print zone. The control performed by the controller such that most or all of the ink of the first color is not applied over the ink of the second color within the overlap print zone.

First Illustrative Embodiment

Figure 1:
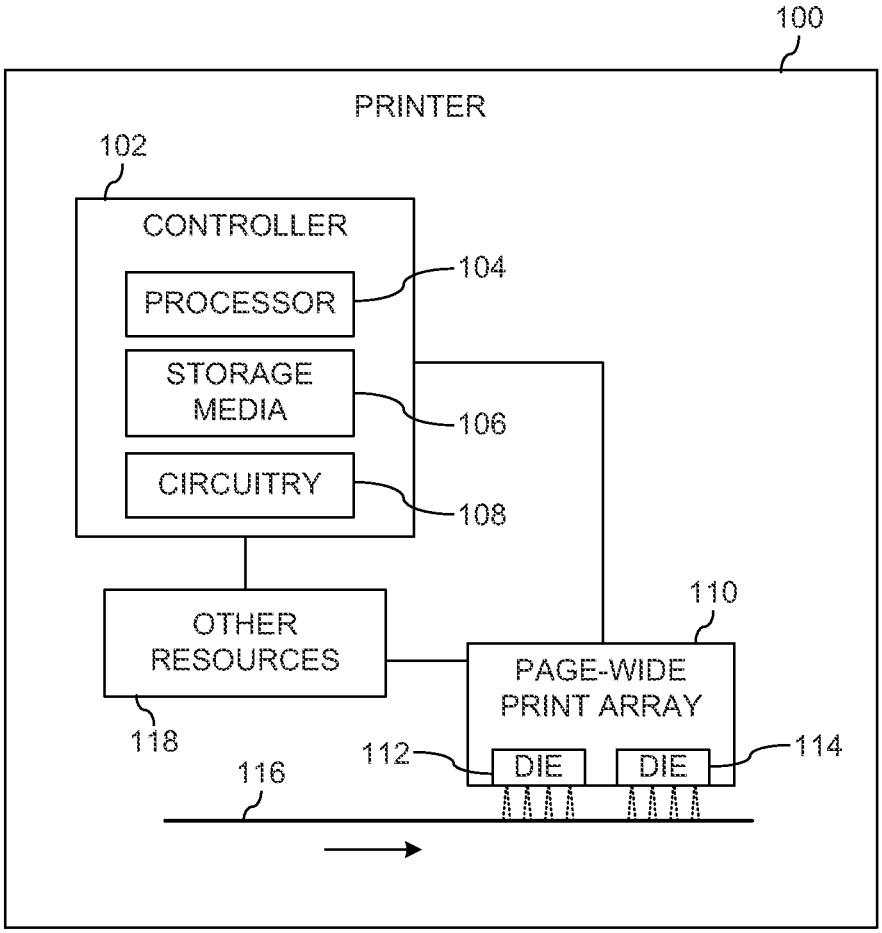
FIG. 1 depicts a block diagrammatic view of a printer according to one embodiment.

FIG. 1 depicts a printer 100 according to one embodiment. The printer 100 is illustrative and non-limiting with respect to the present teachings. Thus, any practical number of other embodiments of printer, web printing system, etc., can be defined and used in accordance with the present teachings.

The printer 100 includes a controller 102. The controller 102 is illustrative and non-limiting in nature. Other embodiments of controller can also be defined and used. The controller 102 is configured to control one or more normal operations of the printer 100 in accordance with the present teachings.

The controller 102 includes a processor 104 configured to execute corresponding program code. Any suitable embodiment of microprocessor, microcontroller or other similar device (or plurality of devices) can be used to define processor 104.

The controller 102 also includes computer-readable storage media (storage media) 106. The storage media 106 includes a program code (not shown) configured for execution by the processor 104. The storage media 106 can be defined by any one or more suitable forms of storage. Non-limiting examples of storage media 106 include solid-state memory, non-volatile memory, optical storage media (CD-ROM, etc.), magnetic storage media (hard drive, floppy disk, etc.), RAM, ROM, programmable read-only memory, etc. Other forms of computer-readable storage media 106 can also be used.

Still referring to FIG. 1, the controller 102 further includes electronic circuitry 108. The circuitry 108 can be defined by any suitable circuitry as needed and/or desired for normal operation of the controller 102. Non-limiting examples of circuitry 108 include power conditioning circuitry, analog-to-digital conversion (ADC) and/or digital-to-analog conversion (DAC), digital logic, state machine logic, application-specific integrated circuitry, etc.

In one or more other embodiments, a controller (not shown) is provided that omits the processor 104 and/or the storage media 106, and operates solely by way of dedicated purpose electronic circuitry. It is to be understood that any suitable electronic means can be used to provide for control of the printer 102 in accordance with the present teachings.

The printer 100 also includes a page-wide print array (array) 110. The array 110 includes a plurality of print dies, of which two illustrative dies 112 and 114 are depicted in FIG. 1. Dies 112 and 114 are understood to be arranged in staggered adjacency to one another as will be described in greater detail hereinafter. Each of dies 112 and 114 are further understood to be members of two respective rows of dies extending into the page of FIG. 1. Thus, other dies (not shown) are assumed to be included in array 100 such that colored inks can be applied to the full printable width of a media 116. Array 110 is configured to operate in accordance with control signals provided by controller 102. Typical, normal operation of the page-wide print array 110 is described in further detail hereinafter.

The printer 100 further includes other resources 118 as needed for normal operation. Non-limiting and illustrative examples of other resources 118 include one or more colored ink supplies, a power supply, input/output data communication circuitry, wireless resources, an operator interface, sheet media transport mechanisms, etc. One having ordinary skill in the printing and/or related arts will appreciate that printer 100 can include various resources as desired in accordance with the present teachings, and that further elaboration of other resources 118 is not required for purposes of understanding the present teachings.

Illustrative and non-limiting operation of the printer 100 is as follows: Media 116, such as paper, is transported in the direction depicted and into operative (i.e., printable) proximity to the page-wide array 110. As such, the media 116 first passes under die 112 where one or more colored inks are applied so as to define imaging (i.e., text, symbols, indicia, photographic images, etc.) thereon. The media 116 then passes under die 114, wherein one or more colored inks are applied so as to complete the imaging to be formed. Controller 102 provides signals that control the application of colored inks by the dies 112 and 114.

For purposes of non-limiting illustration, imaging is presumed to be performed in accordance with an image data file (e.g., text document, photograph, etc.) provided to the printer 100 by an external entity (not shown) such as a computer, network server, or other device. It is further presumed for illustration that the printer 100 operates according to a four color scheme (e.g., black, cyan, magenta and yellow; etc.).

An overlap print zone exists due to the staggered arrangement of the dies 112 and 114. The controller 102 operates so as to control the application of colored inks to the media 116 within the overlap print zone (as well as elsewhere). Specifically, the controller 102 is configured to control operation of the page-wide print array 110 in accordance with a sequential application hierarchy of colors. Such hierarchies can be defined to include any practical number of colors and their order (i.e., ranking) of overlapping placement onto the media. Further elaboration on such sequential application hierarchies is provided hereinafter. The various colors used by the printer 100 are properly controlled according to a sequential application hierarchy resulting in proper hue and color saturation within the imaging formed on the media 116, while accommodating the partial-on-partial ink intensity shingling scheme used within the overlap print zones of the page-wide print array.

Second Illustrative Embodiment

Figure 2A:
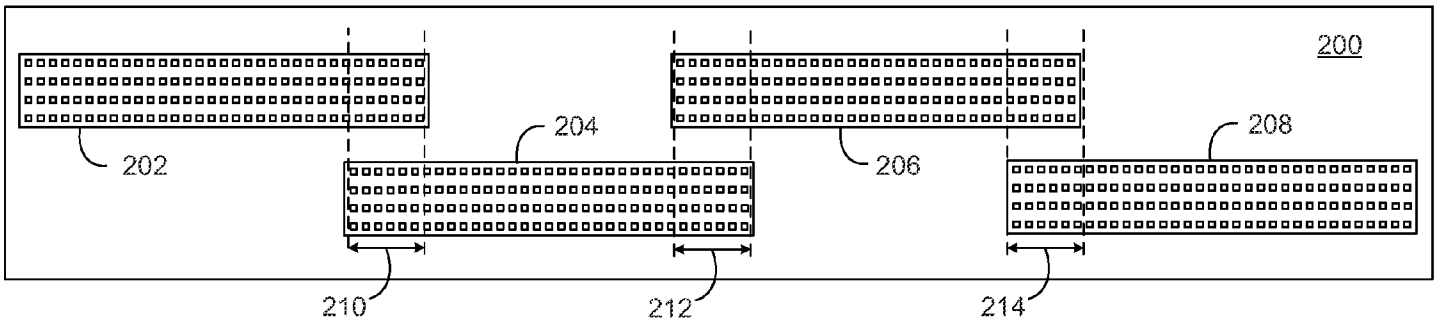
FIG. 2A depicts a schematic plan view of page-wide print array according to another embodiment.

FIG. 2A depicts a page-wide print array (array) 200 according to one embodiment. The array 200 is illustrative and non-limiting in nature. Other arrays (not shown) can also be defined and used in accordance with the present teachings.

The array 200 includes a plurality of print dies (dies) 202, 204, 206 and 208. Each of the dies 202-208 includes a plurality of nozzles arranged in rows, wherein each row corresponds to a color of liquid ink to be applied. As depicted, the dies 202-208 are each configured for operation in accordance with four colors of liquid ink. In another embodiment, a different number of rows can be used within the respective dies. Similarly, the number of nozzles within the rows can vary, as can the offset (pitch) between nozzles and/or die overlap from embodiment to embodiment.

In further reference to FIG. 2A, the dies 202-208 are arranged in staggered adjacency such that respective overlap print zones 210, 212 and 214 are defined. The array 200 is controlled in accordance with a shingling scheme so that proper hue and color saturation are achieved on the receiving media (e.g., paper, etc.) within the overlap print zones 210-214. Such shingling schemes according to the present teachings employ respective sequential application hierarchies.

As depicted in FIG. 2A, the page-wide print array 200 is in plan view looking directly into the nozzles of the respective dies 202-208. In turn, the dies 202-208 are supported in a plane such that a print zone is defined extending across the width (or usable portion) of a media such as paper, etc. While the array 200 includes a total of four dies 202-208 in the interest of simplicity, it is to be understood that other arrays can include any practical number of dies according to the present teachings. The array 200 is typically—but not necessarily—oriented such that ink is discharged downward with respect to gravity onto the receiving media.

Figure 2B:
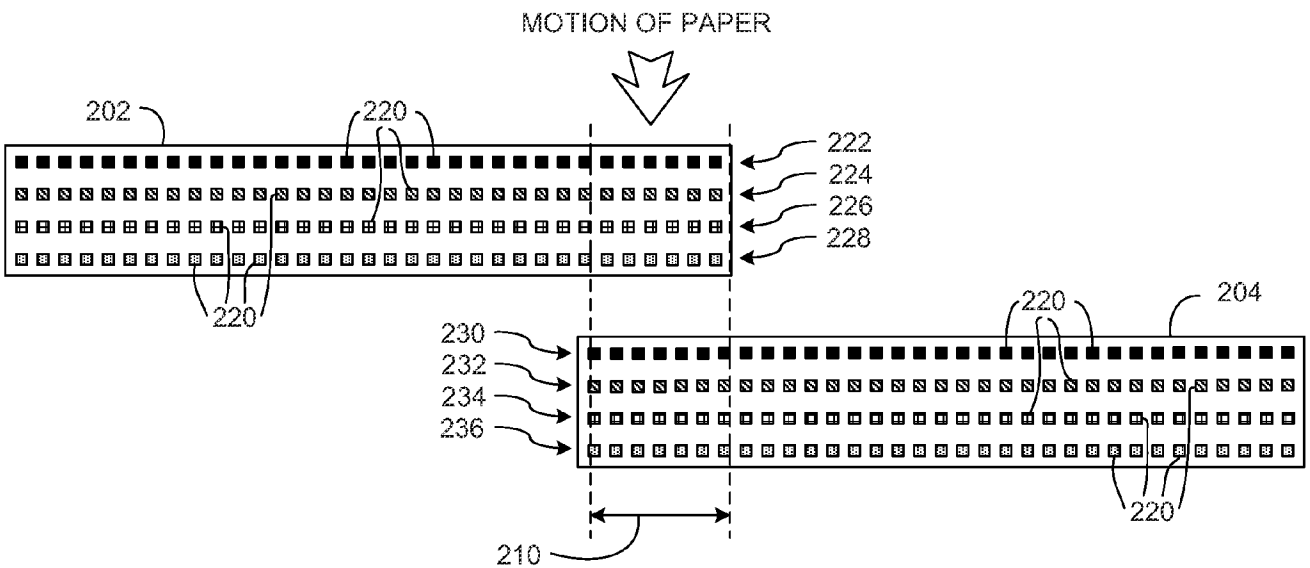
FIG. 2B depicts details of the page-wide print array of FIG. 2A.

FIG. 2B depicts selected details of the page-wide print array (array) 200 as introduced above. The staggered arrangement of the dies 202 and 204 defines the overlap print zone 210. The dies 202 and 204 further include respective pluralities of ink discharge nozzles (nozzles) 220. Each of the nozzles 220 is individually addressable by a corresponding controller (e.g., 102) so as to apply a selective quantity of colored ink over a media during normal operation. As used herein, the phrases "over a media" and "over media" both refer to applying an ink or inks that is/are ultimately supported by the media, and direct contact may be with the media itself or with one or more other underlying color(s) of ink. Thus, any particular application of ink can be directly onto the media, directly onto previously applied ink or inks, or any combination of media and previously applied ink(s), in accordance with the phrases "over a media" and "over media". While the nozzles 220 are depicted as squares in the interest of simplicity, it is to be understood that nozzles in accordance with the present teachings can be defined by any suitable cross-sectional form (e.g., circular, elliptical, etc.).

The respective nozzles 220 of die 202 are arranged into four rows 222, 224, 226 and 228, respectively. In one illustrative and non-limiting embodiment, the nozzles of row 222 are configured and coupled to resources as needed so as to discharge black ink. Similarly, the nozzles of row 224 are configured to discharge cyan ink, the nozzles of row 226 are configured to discharge magenta ink, and the nozzles of row 228 are configured to discharge yellow ink. In another embodiment, other colors, numbers of colors, and/or their order within respective rows can be used.

The respective nozzles 220 of die 204 are arranged into four rows 230, 232, 234 and 236, respectively. In accordance with the present teachings, the corresponding order of colors of the rows 230-236 of die 204 are matched to those of rows 222-228 of die 202. Thus, the nozzles of rows 230, 232, 234 and 236 are configured and supplied so as to discharge black ink, cyan ink, magenta ink and yellow ink, respectively.

During typical operation, a paper media is transported in the direction depicted in FIG. 2B. The order in which colored ink can be applied to the media is determined in accordance with the respective colors assigned to rows 222-228 of the die 202, with likewise color ordering of the rows 230-236 of die 204. In the present and illustrative example, colored inks can be applied to the media as black first, and then cyan, and then magenta, and then yellow. This order is followed in accord with the particular sequential application hierarchy being used. Again, other hierarchies can also be defined and used.

For example, under the present illustrative embodiment, it is assumed that imaging is to be performed within the overlap print zone 210 (and optionally elsewhere, as well). It is also assumed that cyan ink is to be applied over black ink in order to achieve a desired hue. It is further assumed, under the applicable sequential application hierarchy, that it is undesirable to apply any significant amount of black ink over cyan ink, magenta ink or yellow ink. In this case, appropriate individual control of the nozzles 220 of the dies 202 and 204 within the overlap print zone 210 will be performed to ensure that inks are applied in desired color order, onto media and/or previously applied ink(s), without applying a color of lesser hierarchical order over another color of greater hierarchical order. Controlled, hierarchical ink application within the overlap print zones is referred to herein as trapezoidal shingling due to the shape defined by the respectively used and unused nozzles 220 on a particular die.

Table 1 below illustrates just one of numerous possible hierarchies that can be defined and used according to the present teachings.

TABLE 1

| COLOR | MAY BE APPLIED OVER COLOR(S) |
|---|---|
| Black | Black |
| Cyan | Black, Cyan |
| Magenta | Black, Cyan, Magenta |
| Yellow | Black, Cyan, Magenta, Yellow |

First Illustrative Operation

Figure 3:
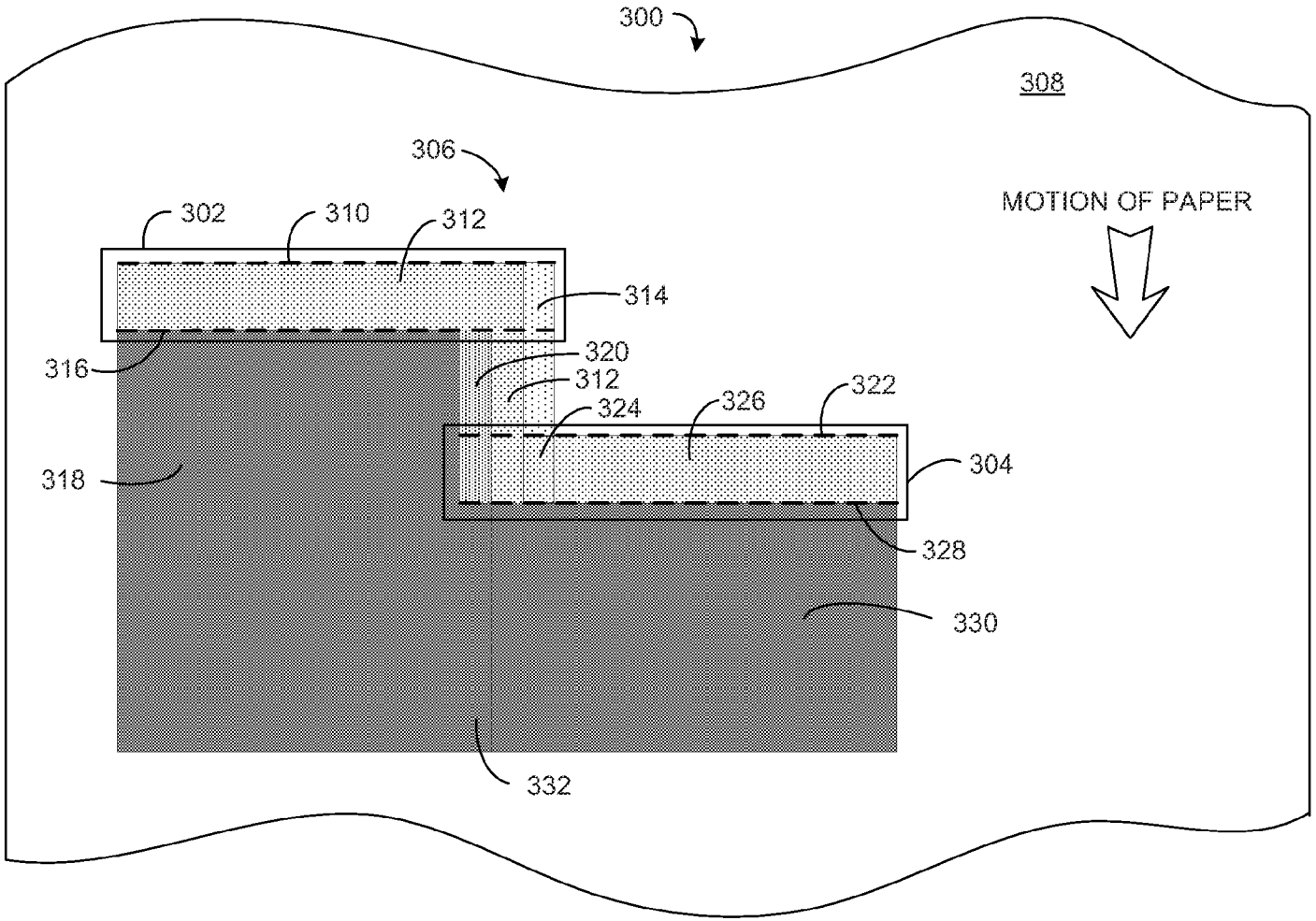
FIG. 3 depicts a shingling operation according to one embodiment.

FIG. 3 depicts a plan view of an illustrative and non-limiting operation 300 in accordance with the present teachings. The operation 300 depicts just one of an essentially unlimited number of shingling operations that can be performed according to the present teachings. Thus, numerous other shingling operations performed in accordance with respective sequential application hierarchies of colors can also be performed within the scope of the present teachings. Operation 300 is performed using a first die 302 and a second the 304 disposed in staggered adjacency to each other such that an overlap print zone 306 is defined. Sheet media (i.e., paper) 308 is transported beneath and into operative proximity to the dies 302 and 304 in the direction indicated.

During operation 300, cyan ink is first applied to the media 308 by way of a row of nozzles 310 of the first die 302. The nozzles of row 310 are individually controlled such that cyan ink is applied at full intensity within a region 312, while cyan ink is applied at less than full intensity (i.e., partial intensity) within a region 314. It is noted that some of the full-intensity application of cyan ink occurs within the overlap print zone 306, while all of the partial-intensity application of cyan ink occurs within the overlap print zone 306. Thus, under illustrative operation 300, cyan ink of respectively different intensities has been applied as side-by-side strips (i.e., adjacent shingles) onto the media 308 within the overlap print zone 306.

The operation 300 also includes the application of magenta ink over the media 308 by way of a row of nozzles 316 of the first die 302. The nozzles of row 316 are individually controlled such that magenta ink is applied at full intensity over a portion of region 312 so as to define a region 318. Magenta ink is also applied at partial intensity (e.g., 50%, etc.) over another portion of region 312 so as to define a region 320. At this point in the operation, regions 314 and 320, as well as a portion of region 312, define parallel, non-overlapping strips (i.e., shingles) on the media 308 within the overlap print zone 306.

The operation 300 of FIG. 3 further includes application of cyan ink to the media 308 by way of a row of nozzles 322 of the second die 304. The nozzles of row 322 are individually controlled such that cyan ink is applied at partial intensity over region 314 so as to define a region 324. Thus, the partial intensity application of the cyan ink to region 324 completes the application of cyan ink within the overlap print zone 306. The nozzles of row 322 are further used to apply cyan ink at full intensity so as to define a region 326. At this point in operation 300, regions 320 and 324, as well as a portion of region 312, define respective shingles on the media 308 within the overlap print zone 306.

Operation 300 also includes the application of magenta ink over the media 308 by way of nozzles of a row 328 of the second die 304. The nozzles of row 328 are individually controlled such that magenta ink is applied at full intensity over a portion of region 312, as well as over regions 324 and 326, so as to define a region 330. The nozzles of row 328 are further controlled such that magenta ink is applied at partial intensity over the region 320 to define a region 332. The application of magenta ink by way of the nozzles of row 328 completes the application of magenta ink to the media 308 overall. It is noted that regions 318, 330 and 332 are joined in a substantially seamless manner on the media and appear as one continuous, visually homogenous area.

The operation 300 depicts the illustrative shingling of ink within the overlap print zone 306, in compliance with a particular sequential application hierarchy of colors. In the exemplary hierarchy of operation 300, magenta ink can be applied over cyan or magenta, but essentially no cyan ink is to be applied over magenta. Furthermore, adjacent strips of different colors and intensities, in accordance with the hierarchy, are applied within the overlap print zone 306 so as to accommodate the staggered nature of multiple-die printing while providing the desired hue and color saturation in the final imaging. Such adjacent strips, or shingles, are generally elongated along the direction of motion of the media 308. Table 2 below summarizes the colors and their order of application within the illustrative and non-limiting operation 300.

TABLE 2

| REGION | ORDER OF APPLIED COLORS |
|---|---|
| 312 | Full cyan over media |
| 314 | Partial cyan over media |
| 318 | Full magenta over full cyan |
| 320 | Partial magenta over full cyan |
| 324 | Partial cyan over partial cyan, yielding full cyan |
| 326 | Full cyan over media |
| 330 | Full magenta over full cyan |
| 332 | Partial magenta over partial magenta over full cyan, yielding full magenta over full cyan |

Illustrative Method

Figure 4:
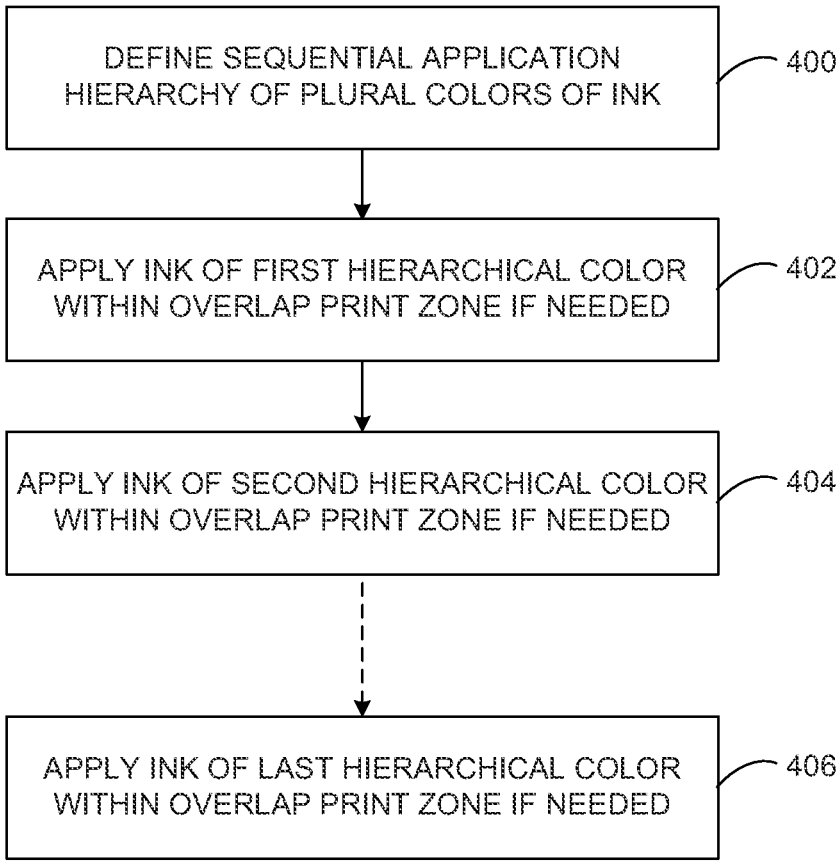
FIG. 4 depicts a method of shingling according to another embodiment.

FIG. 4 is a flowchart depicting a method in accordance with one embodiment. The flowchart of FIG. 4 depicts particular method aspects and order of execution. However, it is to be understood that other methods including and/or omitting certain details, and/or proceeding in other orders of execution, can also be used without departing from the scope of the present teachings. Therefore, the method of FIG. 4 is illustrative and non-limiting in nature. For purposes of illustration, it is assumed that two dies defining an overlap print zone within a larger, overall page-wide print array are used in performing the method of FIG. 4.

At 400, a sequential application hierarchy of plural colors is defined. For purposes of non-limiting example, it is assumed that a hierarchy of fours colors is defined as follows: Black ink, then cyan ink, then magenta ink, and then yellow ink. Other hierarchies of different colors and/or different numbers of colors, and/or different orders of application, can be defined and used according to the present teachings.

At 402, ink of the first hierarchical color is applied directly to at least a portion of media within the overlap print zone. The first ink can be applied at less than full intensity, if so desired. In another instance, the ink of the first hierarchical color is not applied at all. One or more width-wise shingles, elongated along a direction of travel of the media, may be defined within the overlap print zone as a result of 402.

At 404, ink of the second hierarchical color is applied within the overlap print zone. The second ink can be applied at less than full intensity, if so desired. The second ink can, but does not necessarily, overlap at least some of the first ink in the overlap print zone. In another instance, the ink of the second hierarchical color is not applied at all. One or more adjacent, width-wise shingles may be defined and/or modified within the overlap print zone as a result of 404.

The illustrative method according to the present invention continues with the other colors of ink in the predefined hierarchical sequence.

At 406, the ink of the last hierarchical color is applied directly within the overlap print zone. The last ink can be applied at less than full intensity, if so desired. The last ink can, but does not necessarily, overlap at least some of the other ink(s) within the overlap print zone. In another instance, the ink of the last hierarchical color is not applied at all. At this point, the overall imaging to be formed within the overlap print zone is completed.

In general, the foregoing description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

What is claimed is:

1. A method performed using a device having a first die and a second die defining an overlap print zone, the method comprising:

forming distinct adjacent shingles within the overlap print zone over a media, wherein forming the distinct adjacent shingles comprises:

applying an ink of a first color at partial intensity with the first die and with the second die in a first shingle;

applying an ink of a second color at partial intensity with the first die and with the second die in a second shingle; and applying the first color ink at full intensity with the first die in the second shingle and a third shingle, and applying the second color ink at full intensity with the second die in the first shingle and in the third shingle, the third shingle being adjacently between the first shingle and the second shingle.

2. The method according to claim 1, at least most of the ink of the first color not being applied over the ink of the second color within the overlap print zone, the ink of the first color and the ink of the second color corresponding to a sequential application hierarchy of colors.

3. The method according to claim 1 further comprising applying an ink of a third color over the media within the overlap print zone, at least most of the ink of the first color and at least most of the ink of the second color not being applied over the ink of the third color within the overlap print zone.

4. The method according to claim 1 further comprising transporting the media into printable proximity to the overlap print zone, the distinct adjacent shingles being elongated along a direction of transport of the media.

5. The method according to claim 1, the first die and the second die including at least two parallel rows of ink discharge nozzles, the first die and the second die configured to apply the same colors of ink.

6. The method according to claim 1, the first color ink and the second color ink corresponding to a sequential application hierarchy of colors, the sequential application hierarchy of colors being defined by black and then cyan and then magenta and then yellow.

7. One or more computer-readable storage media including a program code, the program code configured to cause one or more processors to control:

application of an ink of a first color over a media at partial intensity with a first die and with a second die in a first shingle within an overlap print zone;

application of an ink of a second color over the media at partial intensity with the first die and with the second die in a second shingle within the overlap print zone; and application of the first color ink at full intensity with the first die in the second shingle and a third shingle, and of the second color ink at full intensity with the second die in the first shingle and in the third shingle over the media within the overlap print zone, the third shingle being distinct from and adjacently between the first shingle and the second shingle, at least most of the first color ink not being applied over the second color ink within the overlap print zone, the first color ink and the second color ink applied so as to form at least a portion of an image within the overlap print zone.

8. The one or more computer-readable storage media according to claim 7, the program code further configured to cause the one or more processors to control application of an ink of a third color over the media within the overlap print zone such that at least most of the ink of the first color and at least most of the ink of the second color is not applied over the ink of the third color within the overlap print zone.

9. The one or more computer-readable storage media according to claim 7, the program code further configured to cause the one or more processors to control transporting of the media into printable proximity to the overlap print zone.

10. The one or more computer-readable storage media according to claim 7, the program code further configured to cause the one or more processors to control individual ink discharge nozzles of a first die and a second die, the ink discharge nozzles arranged in plural rows corresponding to respective colors of ink.

11. The one or more computer-readable storage media according to claim 7, the program code further configured to define a sequential application hierarchy of colors.

12. The one or more computer-readable storage media according to claim 7, the program code further configured such that the shingles are elongated in a direction of motion of the media.

13. A device, comprising:

a first die and a second die configured to discharge ink, the first die and the second die fixedly positioned relative to each other so as to define an overlap print zone; and a controller including electronic circuitry, the controller configured to control:

application of a first color of ink over a media at partial intensity with the first die and with the second die in a first shingle within the overlap print zone;

application of a second color of ink over the media at partial intensity with the first die and with the second die in a second shingle within the overlap print zone; and application of the first color ink at full intensity with the first die in the second shingle and a third shingle and of the second color ink at full intensity with the second die in the first shingle and in the third shingle over the media, the third shingle being distinct from and adjacently between the first shingle and the second shingle within the overlap print zone, such that most or all of the first color ink is not applied over the second color ink within the overlap print zone.

14. The device according to claim 13, the controller further configured to control application of a third color of ink over the media within the overlap print zone such that most or all of the first color of ink and most or all of the second color of ink is not applied over the third color of ink within the overlap print zone.

15. The device according to claim 13, the controller further configured to control application of the first color of ink and the second color of ink such that the shingles are elongated within the overlap print zone in a direction of movement of the media.

* * * * *